US008567031B1

(12) United States Patent
DeHart

(10) Patent No.: US 8,567,031 B1
(45) Date of Patent: Oct. 29, 2013

(54) METHOD AND APPARATUS FOR REMOVING A TUBULAR FLEXIBLE BAG FROM A STACK OF ARTICLES

(75) Inventor: Robert W. DeHart, Mason, OH (US)

(73) Assignee: Airtrim, Inc., Springfield, OH (US)

( * ) Notice: Subject to any disclaimer, the term of this patent is extended or adjusted under 35 U.S.C. 154(b) by 0 days.

(21) Appl. No.: 13/447,602

(22) Filed: Apr. 16, 2012

(51) Int. Cl.
*B23P 19/00* (2006.01)

(52) U.S. Cl.
USPC ..... 29/426.3; 29/426.4; 29/426.5

(58) Field of Classification Search
USPC ..... 29/426.1, 426.2, 426.3, 426.4, 426.5, 29/700
See application file for complete search history.

(56) References Cited

U.S. PATENT DOCUMENTS 4,580,938 A * 4/1986 Mojden et al. ..... 414/796.2
5,375,961 A * 12/1994 Mojden et al. ..... 414/412
6,244,019 B1 * 6/2001 Ljungqvist et al. ..... 53/386.1
6,725,631 B2 4/2004 Skrak et al.

* cited by examiner

*Primary Examiner* — David Bryant
*Assistant Examiner* — Lee Holly
(74) *Attorney, Agent, or Firm* — Jacox, Meckstroth & Jenkins

(57) ABSTRACT

A stack of disk-like articles or can ends are transferred in an elongated tubular paper bag supported between opposing shoes, and the bag is removed from the stack by pulling the bag longitudinally or upwardly after a slitting knife blade moves or pivots from a retracted position to an extended position to pierce the bag and to slit the bag progressively and longitudinally. A stream or jet of air is directed against the end or top article in the stack to prevent the articles from moving with the bag or being flipped over in response to pulling the bag from the stack. Preferably, the air jet is directed from an air supply tube attached to the knife blade for movement with the blade between the retracted position and the extended position. The knife blade is shaped like a hawk beak and has a pointed tip and an arcuate knife edge.

16 Claims, 4 Drawing Sheets

METHOD AND APPARATUS FOR REMOVING A TUBULAR FLEXIBLE BAG FROM A STACK OF ARTICLES

BACKGROUND OF THE INVENTION

The present invention relates to a method and apparatus for debagging or removing a tubular flexible bag from a stack of articles such as aluminum can ends, for example, as disclosed in U.S. Pat. No. 5,375,961, the disclosure of which is herein incorporated by reference. The problem addressed in this patent is to maintain the disk-like articles or can ends in a vertical stack while the tubular bag of flexible material, such as a paper bag, is quickly pulled upwardly from the stack and to prevent some of the articles at the upper end of the stack from moving with the bag or flipping over in the stack in response to pulling the bag upwardly from the stack and from being flipped onto the floor after the bag is removed. The patent discloses a pair of laterally or horizontally opposing retaining members or rollers which are moved horizontally into engagement with the bag immediately above the topmost article in the stack while the bag is being pulled upwardly from the stack. Power operated means, such as air cylinders, are used to move the opposing rollers into engagement with the bag directly above the stack. It is also known to slit a horizontal bag of can ends longitudinally and then pull the bag laterally from the horizontal stack of can ends held between elongated horizontal support shoes.

SUMMARY OF THE INVENTION

The present invention is directed to a new method and apparatus for removing an elongated tubular bag of flexible material from a stack of disk-like articles, for example, a stack of aluminum can ends which are later double-seamed onto filled can bodies to form beverage containers. The apparatus of the invention is simple and economical in construction and is dependable in operation with very low maintenance. The method and apparatus also prevents movement of the uppermost articles in a vertical stack with the bag as the bag is being pulled upwardly from the stack, and thereby avoids flipping of the articles within the bag or spillage of the articles onto the floor after the bag is removed. In general, the method and apparatus of the invention provides for pulling an end portion of the bag from a stack of articles after moving a slitting knife blade into the bag and in response to pulling the bag from the stack. Simultaneously with the progressively slitting of the bag, a jet of air from a compressed air supply is directed against the end article in the stack to prevent any of the articles in the stack from moving with the bag as the bag is being pulled from the stack.

Other features and advantages of the invention will be apparent from the following description, the accompanying drawings and the appended claims.

DESCRIPTION OF THE ILLUSTRATED EMBODIMENT

Figure 1:
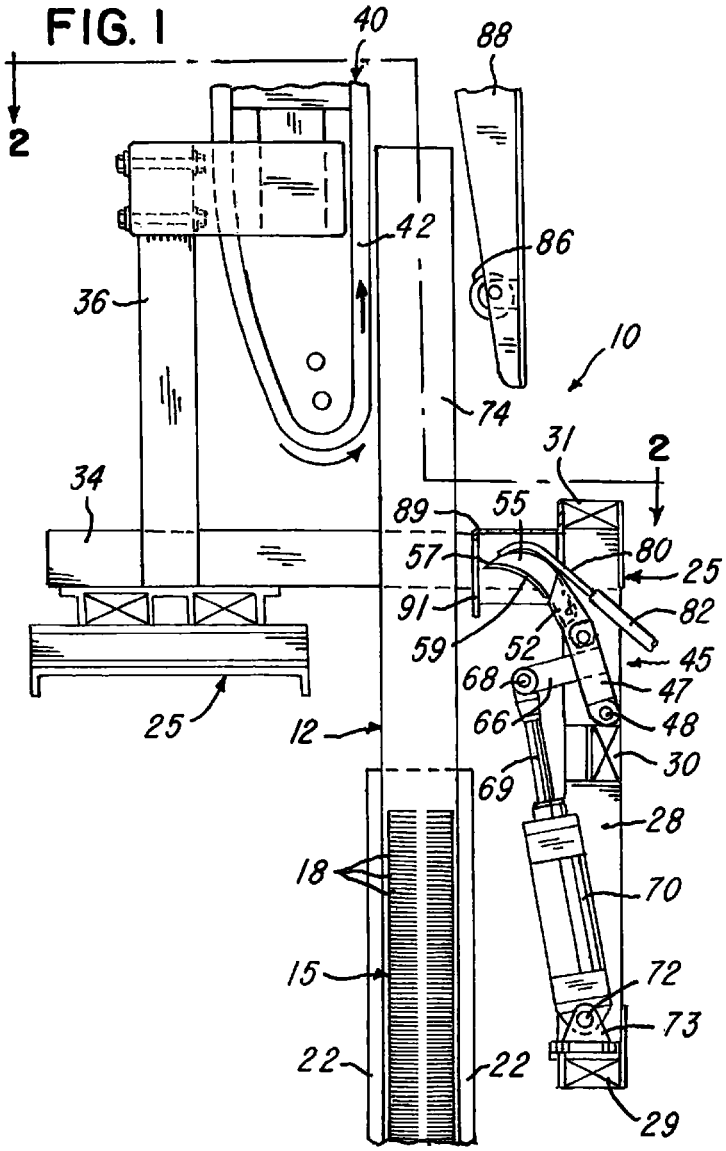
FIG. 1 is a diagrammatic elevational view of debagging apparatus constructed in accordance with the invention and showing a free upper end portion of a bag before the bag is removed or pulled upwardly from a stack of disk-like articles.
Figure 2:
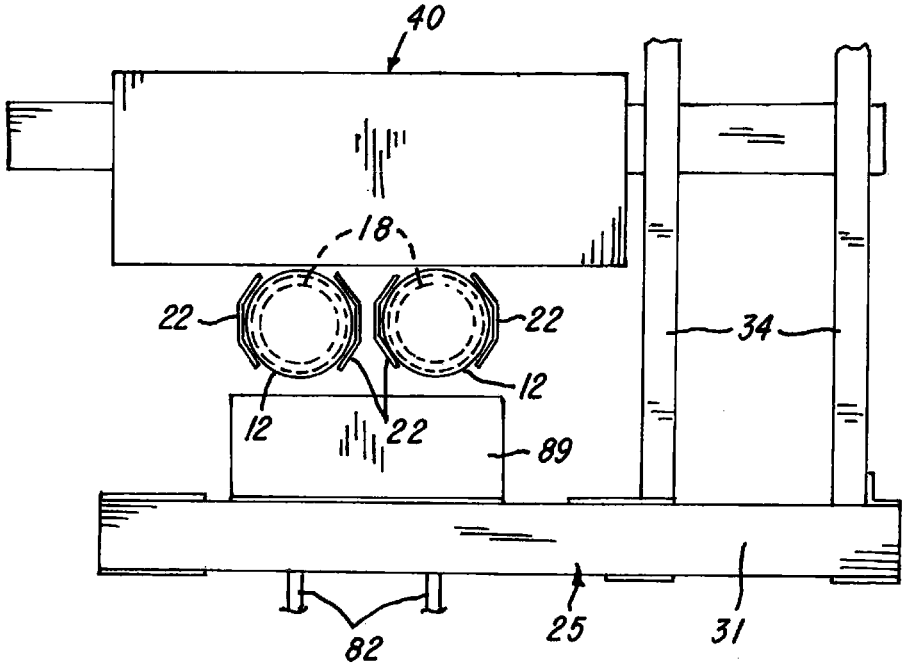
FIG. 2 is a diagrammatic plan view of the apparatus, taken generally on the line 2-2 of FIG. 1.

FIG. 1 illustrates debagging apparatus 10 for removing an elongated tubular bag 12 of flexible material such as paper or plastic film from a stack 15 of disk-like articles 18 illustrated in the form of aluminum can ends. The can ends are commonly double-seamed onto aluminum can bodies after the can bodies have been filled with a beverage. The stack 15 of articles or can ends 18 are commonly transferred by a rotary-type feeder device which has been provided with some form of debagging apparatus, for example, as disclosed in above-mentioned U.S. Pat. No. 5,375,961. The rotary feeding device commonly includes an endless conveyor which has longitudinally spaced and vertically extending laterally opposing elongated vertical racks or shoes 22 (FIG. 2) which confine the stacks 15 of can ends 18 within corresponding vertical paper bags 12 each having an unsealed lower end portion. The endless conveyor commonly advances two vertical stacks 15 of can ends 18 at a time in rapid step-by-step movement to debagging equipment or apparatus which removes the paper bags 12 from the two stacks 15 simultaneously, for example, as disclosed in the above '961 patent.

Figure 5:
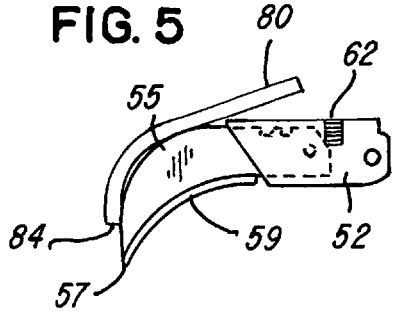
FIG. 5 is an elevational view of the slitting knife and attached air tube assembly shown in FIGS. 1 and 3.

The debagging apparatus 10 of the invention (FIGS. 1 & 2) includes a fabricated metal frame 25 formed by horizontally spaced vertical frame members 28 rigidly connected by horizontal frame members 29, 30 and 31. The frame 25 also includes spaced horizontal frame members 34 and vertical frame members 36 which support an endless power driven conveyor 40 having a vertical run 42 and constructed similar to the conveyor shown in the above '961 patent. In accordance with the invention, the debagging apparatus 10 also includes a pair of horizontally spaced bag slitting mechanisms 45 which are constructed to slit two bags 12 simultaneously. Since both bag slitting mechanisms 45 are identical, only one is described in detail. Thus each of the bag slitting mechanisms 45 includes an arm 47 (FIG. 1) pivotally supported by a shaft 48 supported by a bracket mounted on the cross frame member 30. The arm 47 supports and is secured to a knife holder 52 which supports a replaceable knife blade 55 having a profile of a hawk beak as shown in FIG. 5. The knife blade has a pointed tip 57 and an arcuate sharp knife edge 59, and the knife blade 55 is retained within the holder 52 by a set screw 62.

The knife holder support arm 47 (FIG. 1) is rigidly connected to an actuating lever or arm 66 pivotally connected by a pin 68 to a piston rod 69 of a fluid or air actuated cylinder 70 pivotally supported by a cross pin 72 to a bracket 73 mounted on the cross frame member 29. Actuation of the fluid or air actuated cylinder 70 is effective to pivot the knife support arm 47 and the knife blade 55 between a retracted position (FIG. 1) and an extended position (FIG. 3) causing the knife blade 55 to pierce and cut into an upper projecting empty end portion 74 of the paper bag 12.

Figure 3:
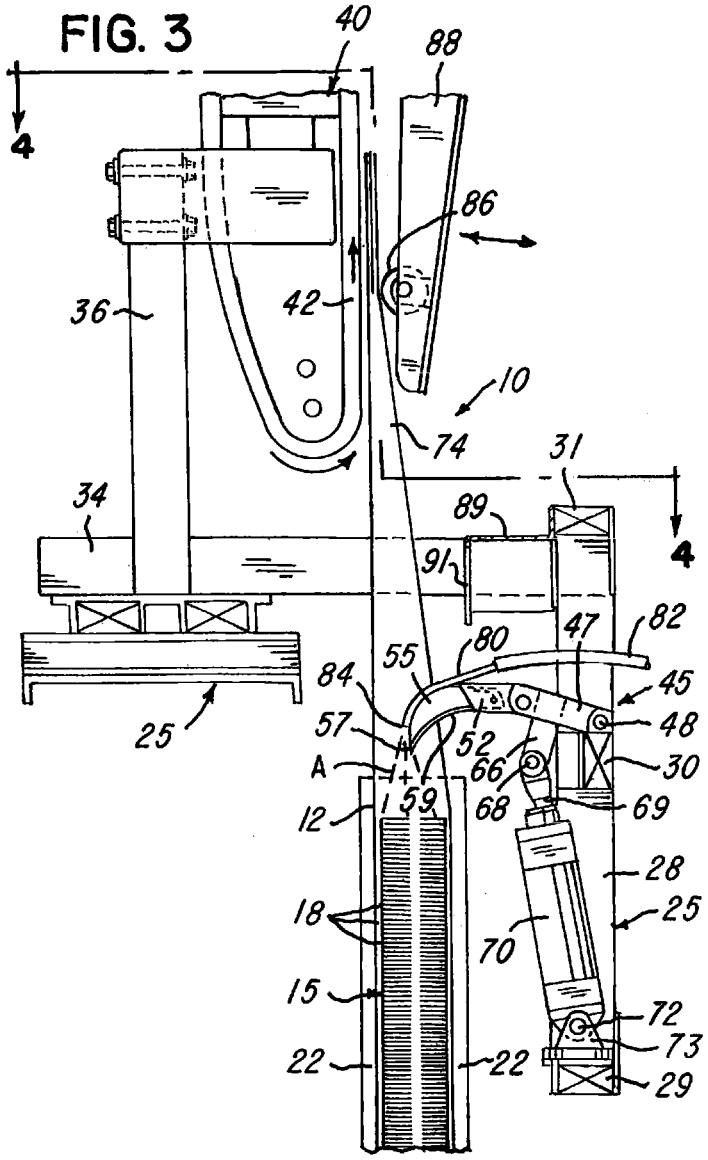
FIG. 3 is an elevational view similar to FIG. 1 and showing a bag being removed or pulled upwardly from a stack of articles with the apparatus of the invention in a position for progressively slitting the bag.
Figure 4:
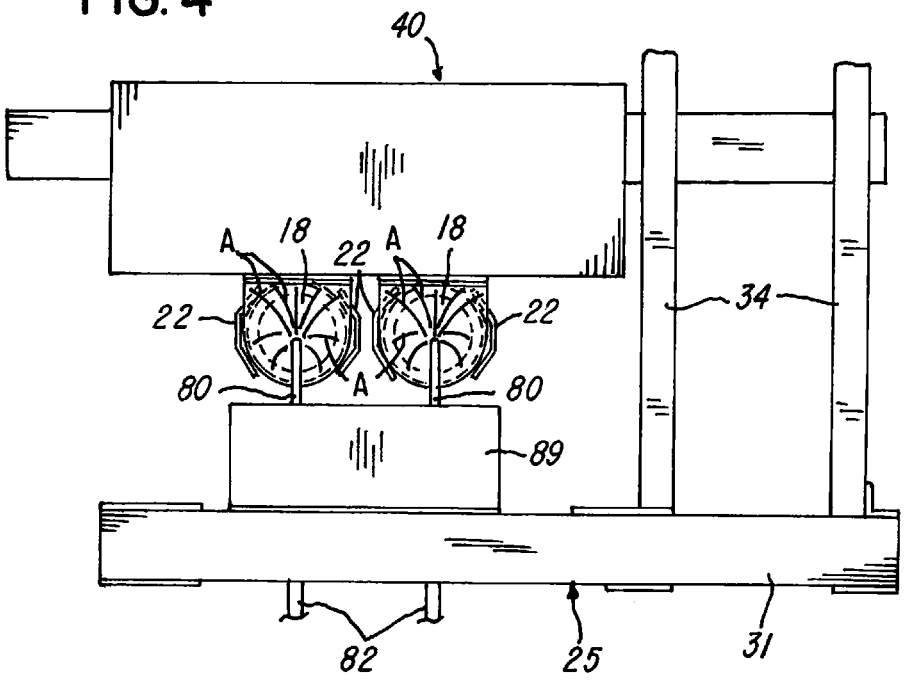
FIG. 4 is a plan view similar to FIG. 2 and taken generally on the line 4-4 of FIG. 3.

As shown in FIGS. 1, 3 & 5, the knife blade 55 supports a formed air direction tube 80 which is attached or secured to the upper edge surface of the knife blade 55, preferably by spot welds. The air tube 80 has an inner end portion which connects with a flexible air supply tube 82 which connects with a pressurized air supply (not shown) having a pressure within a range of 40 to 60 PSI. The air direction tube 80 has an outer end portion 84 which directs an air stream or air jet A downwardly adjacent the outer pointed end portion or tip 57 of the knife blade 55.

In operation, after a pair of vertical paper bags 12 are advanced to the debagging apparatus 10 with each bag enclosing a stack 15 of generally flat articles 18 such as can ends, each bag has an upper end portion 74 which projects upwardly from the stack 15 and passes between the vertical conveyor run 42 and a pinch roller 86 mounted on a depending arm 88 supported for pivotal or oscillating movement produced by a fluid or air cylinder (not shown). As the roller 86 presses the upper empty end portion 74 of each paper bag against the vertical upwardly moving endless conveyor run 42, the slitting knife 55 is simultaneously actuated and pivoted between its retracted position (FIG. 1) to its extended position (FIG. 3) so that the knife 55 pierces and slits the paper bag 12. The knife continues to slit the bag 12 longitudinally as the paper bag is pulled upwardly by pinching the collapsed portion of the empty paper bag 12 with the roller 86 against the upwardly moving endless conveyor run 42.

As soon as the knife blade 55 pierces the paper bag and commences to slit the bag longitudinally, a jet of air A from the end portion 84 of the air supply tube 80 is directed downwardly against the topmost article or can end 18 within the slit bag 12 so that none of the uppermost can ends 18 move upwardly with the bag 12 due to friction between the bag and the can ends as the bag is removed or pulled upwardly from the stack 15 of can ends. As soon as each bag 12 is completely removed, the empty bag is sucked upwardly into a waste conveyor or air suction duct, and the knife blade 55 and attached air tube 80 are pivoted to the retracted position shown in FIG. 1 by activation of the air cylinder 70. The next pair of bags 12 enclosing corresponding stacks 15 of can ends are then advanced into the debagging apparatus 10 and the cycle of operation is repeated. As shown in FIGS. 1-4, the pair of retractable knives 55 are covered by a housing 89 in their retracted positions, and the housing has vertical slots 91 through which the knives 55 and attached air tubes 80 move when extended.

While the method and form of debagging apparatus herein described constitutes a preferred embodiment of the invention, it is to be understood that the invention is not limited to this precise method and form of apparatus described, and that changes made therein without departing from the scope and spirit of the invention as defined in the appended claims.

What is claimed is:

1. A method of removing an elongated tubular bag of flexible material from a stack of disk shaped articles, with the bag having an end portion projecting from the stack, comprising the steps of pulling the end portion of the bag from the stack, moving a slitting knife blade from a retracted position to an extended position, piercing the bag with the knife blade while moving the knife blade from the retracted position to the extended position, progressively slitting the bag longitudinally with the knife blade in response to pulling the bag from the stack, and directing a jet of air from an air supply against an endmost article in the stack to prevent articles in the stack from moving longitudinally with the bag due to friction between the bag and the articles.

2. A method as defined in claim 1 and including the step of connecting an air direction tube to the air supply and to the knife blade for movement of the tube with the knife blade between the retracted position and the extended position.

3. A method as defined in claim 2 and including the step of welding the air direction tube to a portion of the knife blade.

4. A method as defined in claim 1 and including the step of supporting the knife blade for pivotal movement between the retracted position and the extended position, and pivoting the knife blade with a fluid actuated cylinder.

5. A method as defined in claim 4 and including the step of attaching an air direction tube to a portion of the knife blade for pivotal movement of the tube with the knife blade.

6. A method as defined in claim 1 and including the step of forming the knife blade with a pointed end portion and a curved knife edge extending from the pointed end portion to facilitate quickly piercing and slitting the bag.

7. A method as defined in claim 1 wherein the bag is pulled between a linear run of any endless conveyor and a pinch roller pressing the bag against the linear run of the conveyor.

8. A method as defined in claim 1 and including the steps of supporting the stack of articles within the bag between spaced opposing guide shoes, and moving the knife blade between the guide shoes when the knife blade is moved between the retracted position and the extended position.

9. A method of removing an elongated tubular bag of flexible material from a vertical stack of disk shaped articles, with the bag having an upper end portion projecting above the stack, comprising the steps of pulling the upper end portion of the bag upwardly, moving a slitting knife blade from a retracted position to an extended position, piercing the bag with the knife blade while moving the knife blade from the retracted position to the extended position, slitting the bag longitudinally with the knife blade in response to pulling the bag upwardly, and directing a jet of air from an air supply downwardly against the top article in the vertical stack to prevent articles in the stack from moving upwardly with the bag due to friction between the bag and the articles.

10. A method as defined in claim 9 and including the step of connecting an air direction tube to the air supply and to the knife blade for movement with the knife blade between the retracted position and the extended position.

11. A method as defined in claim 10 and including the step of mounting the air direction tube on a top portion of the knife blade.

12. A method as defined in claim 9 and including the step of supporting the knife blade for pivotal movement between the retracted position and the extended position, and pivoting the knife blade with a fluid actuated cylinder.

13. A method as defined in claim 12 and including the step of attaching an air direction tube to a top portion of the knife blade for pivotal movement with the knife blade.

14. A method as defined in claim 9 and including the step of forming the knife blade with a pointed end portion and a curved knife edge extending from the pointed end portion to facilitate quickly piercing the bag.

15. A method as defined in claim 9 wherein the bag is pulled upwardly between a linear run of any endless conveyor and a pinch roller pressing the bag against the linear run of the conveyor.

16. A method as defined in claim 9 and including the steps of supporting the vertical stack of articles within the bag between spaced opposing vertical guide shoes, and moving the knife blade between the guide shoes when the knife blade is moved between the retracted position and the extended position.

* * * * *